US010992032B2

(12) United States Patent
Kim et al.

(10) Patent No.: US 10,992,032 B2
(45) Date of Patent: Apr. 27, 2021

(54) ANTENNA APPARATUS FOR VEHICLE

(71) Applicant: LS MTRON LTD., Anyang-si (KR)

(72) Inventors: Tae-Hyung Kim, Anyang-si (KR); Hee-Chul Jung, Anyang-si (KR); Seung-Ho Choi, Anyang-si (KR)

(73) Assignee: LS MTRON LTD., Anyang-si (KR)

( * ) Notice: Subject to any disclaimer, the term of this patent is extended or adjusted under 35 U.S.C. 154(b) by 58 days.

(21) Appl. No.: 16/603,759

(22) PCT Filed: Apr. 19, 2018

(86) PCT No.: PCT/KR2018/004579
§ 371 (c)(1),
(2) Date: Oct. 8, 2019

(87) PCT Pub. No.: WO2018/194405
PCT Pub. Date: Oct. 25, 2018

(65) Prior Publication Data

US 2021/0098866 A1 Apr. 1, 2021

(30) Foreign Application Priority Data

Apr. 20, 2017 (KR) ..... 10-2017-0051287
Mar. 28, 2018 (KR) ..... 10-2018-0036134

(51) Int. Cl.
*H01Q 1/32* (2006.01)
*H01Q 1/36* (2006.01)
(Continued)

(52) U.S. Cl.
CPC ..... *H01Q 1/32* (2013.01); *H01Q 1/1214* (2013.01); *H01Q 1/36* (2013.01); *H01Q 5/378* (2015.01);
(Continued)

(58) Field of Classification Search
CPC ..... H01Q 1/32; H01Q 21/30; H01Q 9/28; H01Q 1/36; H01Q 1/1214; H01Q 5/378; H01Q 9/32
See application file for complete search history.

(56) References Cited

U.S. PATENT DOCUMENTS 5,650,792 A * 7/1997 Moore ..... H01Q 1/362 343/725
2003/0137463 A1* 7/2003 Shimizu ..... H01Q 9/30 343/713

FOREIGN PATENT DOCUMENTS

EP 0637093 A1 2/1995
EP 1187253 A1 3/2002
(Continued)

OTHER PUBLICATIONS

International Search Report for related International Application No. PCT/KR2018/004579; report dated Oct. 25, 2018; (3 Pages).
(Continued)

*Primary Examiner* — Dieu Hien T Duong
(74) *Attorney, Agent, or Firm* — K&L Gates LLP

(57) ABSTRACT

An antenna apparatus for a vehicle comprises: a first antenna connected to a signal processing substrate; and a second antenna connected to the signal processing substrate through the first antenna and operating in a frequency band different from that of the first antenna, wherein the first antenna comprises: a first radiator for detachably fixing one end of the second antenna; a second radiator operated as a dipole antenna together with the first radiator; and a third radiator for controlling a beam pattern radiated by the first radiator and the second radiator.

15 Claims, 12 Drawing Sheets

(51) Int. Cl.

| | |
|---|---|
| ***H01Q 5/378*** | (2015.01) |
| ***H01Q 21/30*** | (2006.01) |
| ***H01Q 9/28*** | (2006.01) |
| ***H01Q 9/32*** | (2006.01) |
| ***H01Q 1/12*** | (2006.01) |

(52) U.S. Cl.
CPC ..... *H01Q 9/28* (2013.01); *H01Q 9/32* (2013.01); *H01Q 21/30* (2013.01)

(56) References Cited

FOREIGN PATENT DOCUMENTS

| | | | |
|---|---|---|---|
| EP | 1291967 | A1 | 3/2003 |
| JP | H11355019 | A | 12/1999 |
| JP | 2004228909 | A | 8/2004 |
| JP | 2007228456 | A | 9/2007 |
| JP | 2014-93623 | | 5/2014 |
| KR | 20120088471 | A | 8/2012 |
| KR | 20130009124 | A | 1/2013 |
| KR | 20130127669 | A | 11/2013 |
| KR | 20150062087 | A | 6/2015 |
| KR | 10-1567187 | | 11/2015 |
| KR | 101622170 | | 5/2016 |
| KR | 10-1709077 | | 2/2017 |

OTHER PUBLICATIONS

Written Opinion for related International Application No. PCT/KR2018/004579; report dated Oct. 25, 2018; (3 Pages).

* cited by examiner (a)

(b)

(a)

(b)

(a)

(b)

ANTENNA APPARATUS FOR VEHICLE

CROSS REFERENCE TO RELATED APPLICATIONS

The present application is a National Stage of International Application No. PCT/KR2018/004579 filed on Apr. 19, 2018, which claims priority to Korean Patent Application No. 10-2017-0051287 filed on Apr. 20, 2017 and Korean Patent Application No. 10-2018-0036134 filed on Mar. 28, 2018 with the Korean Intellectual Property Office, the entire contents of each hereby incorporated by reference.

FIELD OF TECHNOLOGY

The present disclosure relates to an antenna apparatus for a vehicle, and more particularly, to an antenna apparatus for a vehicle optimized for Vehicle to Everything (hereinafter, V2X) with optimal radiation pattern in horizontal direction.

BACKGROUND

Recently, an autonomous car is raised as a social issue. This is based on Intelligent transportation System (ITS), and the ITS is high technology that manages incidents through vehicle-to-vehicle (V2V) and vehicle-to-infrastructure (V2I) communication using WAVE frequency, thereby minimizing car accidents. This is also based on V2X communication technology or V2X communication system. The V2X communication system contributes remarkably to the car accidents prevention, for example, front obstruction detection, traffic control, emergency vehicle to pass without stop at intersections, accident prevention in intersection blind spots and detection of bicycle and motorcycle access, according to its applied services.

For smooth V2X communication, optimal radiation in the frontward and rearward direction of the vehicle, i.e., with respect to the horizontal plane is essential, but generally, in the case of an antenna mounted on the automobile roof, horizontal plane radiation is not smooth.

FIG. 1 is a diagram showing a configuration of a conventional antenna apparatus for a vehicle. Referring to FIG. 1, the antenna apparatus 10 for a vehicle includes a base 11, a signal processing substrate 13, an antenna unit 15 and a case 17.

The base 11 is an element disposed at the bottom of the antenna apparatus 10 for a vehicle and having a plate shape on the whole, and its lower surface is coupled to an outer panel of the vehicle, and the signal processing substrate 13 and the antenna unit 15 are installed on top. According to an embodiment, the base 11 and the case 17 are coupled to form a shark fin structure, and may reduce air resistance and wind noise occurring when the vehicle moves. The coupling between the base 11 and the case 17 may be made by various methods, and for example, they may be coupled using a bolt and a nut.

The signal processing substrate 13 is coupled to one surface of the base 11 and processes a signal received through the antenna unit 15. For example, the signal processing substrate 13 filters a signal of a desired frequency band using a band-pass filter to remove noise and amplifies to a necessary level. Various types of antenna elements, a fixing device for fixing the antenna elements, a screw groove coupled to the case 17 and antenna elements may be connected to one surface of the signal processing substrate 13 to form a circuit wiring.

The antenna unit 15 may be disposed in the antenna apparatus 10 for a vehicle to obtain the radiation characteristics and efficiency of the antenna to the maximum extent and transmit and receive various types of signals. The antenna unit 15 includes a GNSS antenna 151, an SXM antenna 153 and an antenna 155 for communication. The GNSS antenna 151 and the SXM antenna 153 are patch antennas, and the antenna 155 for communication is a coil type monopole antenna that receives FM/AM signals and communication signals such as LTE.

The case 17 is coupled with the base 11 and accommodates the signal processing substrate 13 and the antenna unit 15 in its inner accommodating space. Additionally, the case 17 has a dome shape with an open bottom and a hollow inner part, and has a height of a predetermined length or more to accommodate elements such as the antenna unit 15 therein.

As shown in FIG. 1, the conventional antenna apparatus for a vehicle is implemented in the form of a Shark Fin. The shark fin type antenna apparatus for a vehicle uses the automobile roof as GND, and the shark fin type antenna apparatus for a vehicle has poor radiation in the direction of the horizontal plane suitable for V2X communication by the influence of the automobile roof. Additionally, the conventional antenna apparatus for a vehicle includes a plurality of antennas, and when a V2X antenna for supporting V2X communication is added, the antenna apparatus for a vehicle increases in size. This is against the recent movement towards reducing the size.

The present disclosure is designed to solve the above-described problem, and therefore the present disclosure is directed to providing an antenna apparatus for a vehicle that is easy to have the effective communication distance due to high radiation efficiency in the frontward and rearward direction of the vehicle in V2X communication.

SUMMARY

An antenna apparatus for a vehicle according to an aspect includes a first antenna connected to a signal processing substrate, and a second antenna connected to the signal processing substrate through the first antenna and operating in a frequency band different from that of the first antenna, wherein the first antenna includes a first radiator for detachably fixing one end of the second antenna, a second radiator operated as a dipole antenna together with the first radiator, and a third radiator for controlling a beam pattern radiated by the first radiator and the second radiator.

The third radiator may include a support extending in a perpendicular direction of the signal processing substrate, and the third radiator may be vertically coupled to the support and disposed on one or two sides of a direction in which the first radiator and the second radiator are arranged.

The third radiator may include an electrical length corresponding to a value obtained by multiplying ¼ of a signal wavelength radiated from the first radiator and the second radiator by 0.92.

The signal wavelength may be in a range between 0.17 m and 0.28 m.

The third radiator may extend in a perpendicular direction of the signal processing substrate and may be disposed on one or two sides of an area in which the first radiator and the second radiator are close to each other.

The third radiator may be spaced apart by a distance corresponding to ¼ of a signal wavelength radiated from the first radiator and the second radiator.

When the second antenna is press-fitted into the first radiator, the first radiator may be elastically deformed and elastically coupled with one end of the second antenna.

The first radiator may be formed in a socket shape corresponding to a ball shape of one end of the second antenna for elastic coupling with the second antenna, and an entry diameter of the socket shape may be smaller than a diameter of the ball shape.

The first radiator may be a metal plate of a conductive material and may be formed in the socket shape in cross section with one end electrically connected to a feeder, the other end being electrically open and a central part being bent.

The first radiator may be a hexahedron of a conductive material with an opening formed on an upper surface and an insertion groove recessed therein, and an entry diameter of the opening may be smaller than a diameter of the ball shape of one end of the second antenna and the insertion groove may be formed in the socket shape corresponding to the ball shape of one end of the second antenna.

The first radiator may include a base, and a pair of extensions extending from the base and having opposing convex portions.

The pair of extensions may be spaced a preset distance apart and elastically deformable.

The second radiator may be formed in a folded shape with one end being electrically connected to the feeder and the other end being electrically open.

The first radiator and the second radiator may be spaced apart by a distance corresponding to 1/10 of a signal wavelength radiated from the first radiator and the second radiator.

The signal wavelength may be in a range between 0.075 m and 0.155 m.

According to an embodiment, it is possible to achieve smooth V2X communication by increasing directivity in the horizontal direction in front and rear of the vehicle.

According to an embodiment, it is possible to overcome the space limitation of automobile antennas and provide V2X communication function to the vehicle without extra stand-alone port and antenna.

According to an embodiment, it is possible to provide V2X services (leisure services, and vehicle services including driving pattern, real-time traffic information, safety related information) to vehicles and pedestrians that transmit and receive V2X communication signals, and provide safety related information to drivers and pedestrians, thereby preventing accidents.

DETAILED DESCRIPTION

Figure 1:
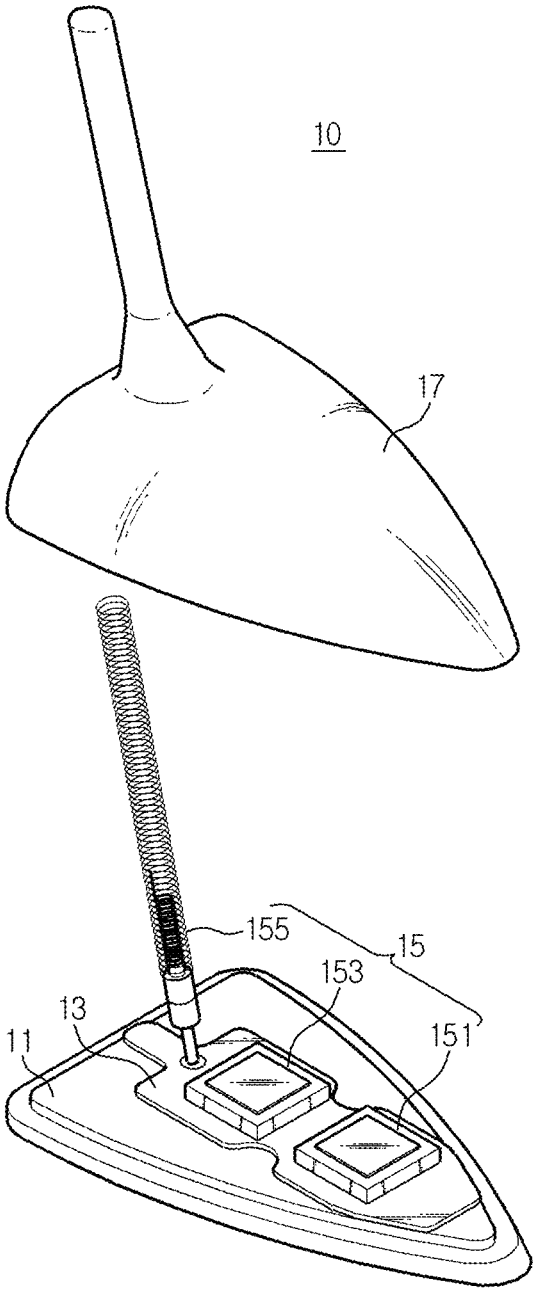
FIG. 1 is a diagram showing a configuration of a conventional antenna apparatus for a vehicle.

Hereinafter, the embodiments of the present disclosure will be described in detail with reference to the accompanying drawings. The embodiments of the present disclosure may be modified in many forms, and the scope of the present disclosure should not be interpreted as limited to the following embodiments. These disclosed embodiment are provided for a further understanding of those having ordinary skill in the art. Additionally, specific terms are used in the drawings and the specification, but they are only used to describe the present disclosure, but not intended to limit the meaning or the scope of the present disclosure set forth in the appended claims. Therefore, those having ordinary skill in the art will understand that various modifications and equivalents may be made thereto. Accordingly, the true scope of technical protection of the present disclosure should be defined by the technical aspects of the appended claims.

An antenna apparatus for a vehicle of the present disclosure will be described in detail with reference to the accompanying drawings.

Figure 2:
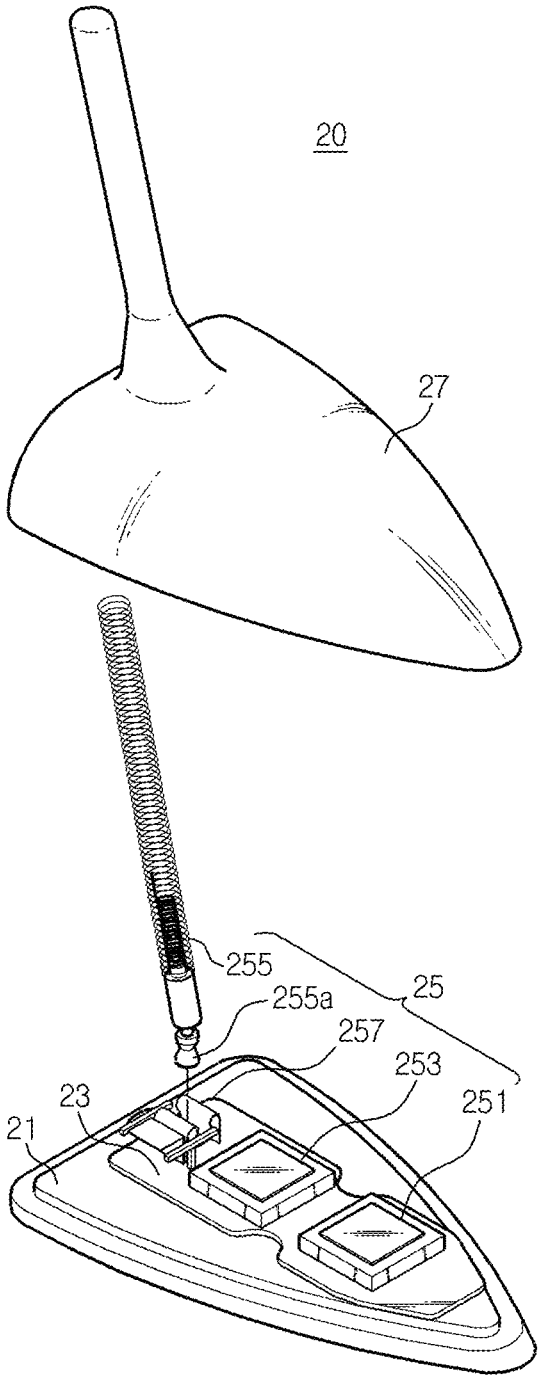
FIG. 2 is a partial exploded perspective view of an antenna apparatus for a vehicle according to an embodiment.

Referring to FIG. 2, the antenna apparatus 20 for a vehicle includes a base 21, a signal processing substrate 23, an antenna unit 25 and a case 27.

The base 21 is an element disposed at the bottom of the antenna apparatus 20 for a vehicle and having a plate shape on the whole, and its lower surface is coupled to an outer panel of the vehicle, and the signal processing substrate 23 and the antenna unit 25 are installed on top. According to an embodiment, the base 21 and the case 27 are coupled to form a shark fin structure, and may reduce air resistance and wind noise occurring when the vehicle moves. The coupling between the base 21 and the case 27 may be made by various methods, and for example, they may be coupled using a bolt and a nut.

The signal processing substrate 23 is coupled to one surface of the base 21 and processes a signal received through the antenna unit 25. For example, the signal processing substrate 23 filters a signal of a desired frequency band using a band-pass filter to remove noise and amplifies to a necessary level. Various types of antenna elements, a fixing device for fixing the antenna elements, a screw groove coupled with the case 27 and antenna elements are connected to one surface of the signal processing substrate 23 to form a circuit wiring. For example, the signal processing substrate 23 may be implemented in the form of a Printed Circuit Board (PCB).

The antenna unit 25 is disposed in the antenna apparatus 20 for a vehicle to obtain the radiation characteristics and efficiency of the antenna to the maximum extent and transmits and receives various types of signals. The antenna unit 25 includes a GNSS antenna 251, an SXM antenna 253, an antenna 255 for communication and a V2X antenna 257.

The GNSS antenna 251 may receive a Global Navigation Satellite System (GNSS) signal. The GNSS antenna 251 may include antennas for receiving satellite frequencies of GPS (US), GLONASS (Russia) and Galileo (Europe) and receive accurate positioning services anywhere in the world.

The SXM antenna 253 may receive an SXM signal for a US satellite multimedia service. The GNSS antenna 251 and the SXM antenna 253 are installed on the ground plane of the signal processing substrate 23, and a dielectric and an antenna patch are stacked in a sequential order. That is, the GNSS antenna 251 and the SXM antenna 253 may be formed of a general patch antenna type.

The antenna 255 for communication may receive an AM/FM radio signal and a signal for communication such as LTE. The antenna 255 for communication is a monopole type antenna, and includes two helical coils with different pitches. Here, the pitch refers to the distance between two windings of the coil, and each area with different pitches has different frequency band characteristics. However, the present disclosure is not limited thereto, and may have different pitches in the lengthwise direction of one helical coil.

One end of the antenna 255 for communication may include a coupling portion 255*a*. The coupling portion 255*a* is not directly connected to the signal processing substrate 23, and is indirectly connected to the signal processing substrate 23 through the V2X antenna 257.

The V2X antenna 257 receives a V2X signal for V2X communication. The V2X antenna 257 transmits and receives the V2X signal and connects the antenna 255 for communication to the signal processing substrate 23. To this end, the V2X antenna 257 may include a fixing structure into which the coupling portion 255*a* formed at one end of the antenna 255 for communication is detachably inserted and fixed.

According to an embodiment, the V2X antenna 257 may carry out V2X communication using WAVE frequency. Here, Wireless Access in Vehicular Environment (WAVE) frequency uses 5.8 GHz~5.9 GHz and has high linearity due to the short wavelength, and when optimized in the direction of the horizontal plane in which the vehicle travels, it is easy to have the effective communication distance. Additionally, V2X communication includes Vehicle-to-Infrastructure (hereinafter V2I) communication, Vehicle-to-Vehicle (hereinafter V2V communication), and (Vehicle-to-Nomadic devices (hereinafter V2N) communication. Accordingly, the vehicle including the V2X antenna 257 may realize an Intelligent Transportation System (ITS) by receiving internal/external wireless data and providing a driver-centered service.

According to another embodiment, the V2X antenna 257 may transmit and receive a radio signal (AM/FM), a broadcast signal (DMB, DAB, SXM, etc.), a communication signal (3G, 4G, LTE), etc.

The case 27 is coupled with the base 21 and accommodates the signal processing substrate 23 and the antenna unit 25 in its inner accommodating space. According to an embodiment, the case 27 has a dome shape with an open bottom and a hollow inner part, and has a height of a predetermined length or more to receive elements such as the antenna unit 25 therein.

Figure 3:
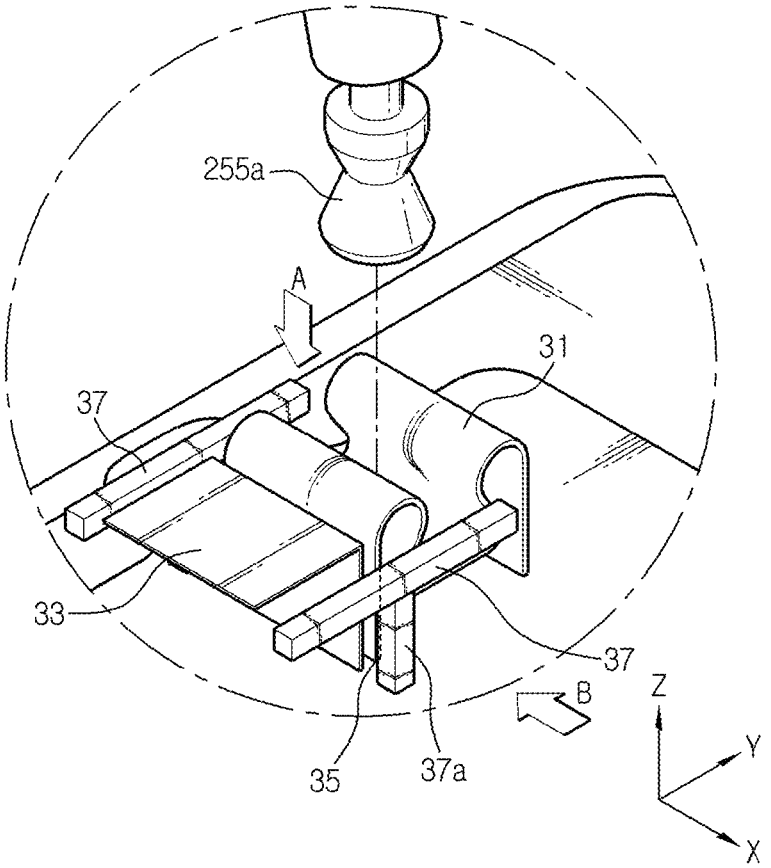
FIG. 3 is an enlarged view showing a detailed entire structure of a V2X antenna of FIG. 2.
Figure 4:
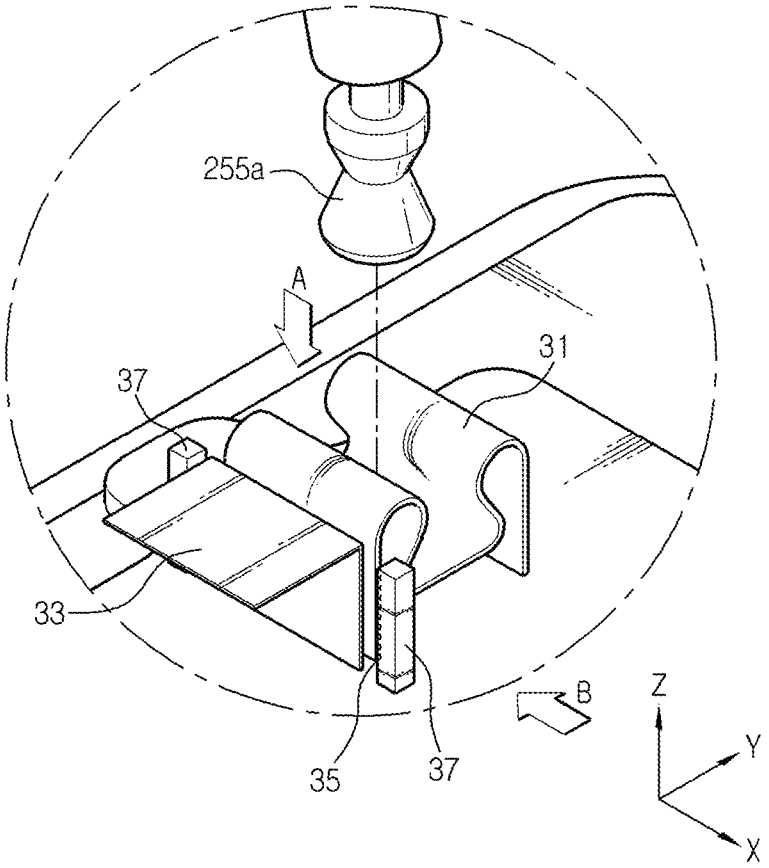
FIG. 4 is a diagram showing another embodiment of a third radiator of FIG. 3.

FIG. 3 is an enlarged view showing a detailed entire structure of the V2X antenna of FIG. 2, and FIG. 4 is a diagram showing another embodiment of a third radiator of FIG. 3.

Referring to FIG. 3, the V2X antenna 257 may include a first radiator 31, a second radiator 33, a feeder 35 and a third radiator 37.

According to an embodiment, the V2X antenna 257 has electrical properties corresponding to a dipole antenna. That is, the first radiator 31 and the second radiator 33 act as a radiator that transmit and receive an RF signal, and the sum of electrical lengths of the first radiator 31 and the second radiator 33 corresponds to the half of the radiated RF signal wavelength λ.

The V2X antenna 257 may function as a connector that connects an antenna operating in a different frequency band to the signal processing substrate 23. In this embodiment, referring to FIGS. 2 and 3, the antenna connected to the signal processing substrate 23 through the V2X antenna 257 is the antenna 255 for communication.

The first radiator 31 may detachably fix the coupling portion 255*a* formed at one end of the antenna 255 for communication. That is, when the antenna 255 for communication is press-fitted into the first radiator 31, the first radiator 31 may be elastically deformed and elastically coupled with the coupling portion 255*a* formed at one end of the antenna 255 for communication.

The second radiator 33 may act as a radiator that radiates an RF signal fed and receives an RF signal transmitted from the outside, together with the first radiator 31. According to an embodiment, the second radiator 33 may act as a dipole antenna with the first radiator 31.

The feeder 35 provides a feed signal and ground voltage to the first radiator 31 and the second radiator 33.

The third radiator 37 may increase the antenna gain in the frontward and rearward direction of the vehicle by controlling a beam pattern radiated from the first radiator 31 and the second radiator 33, and may be referred to as a parasitic element. When directivity is increased in the frontward and rearward direction of the vehicle by the control of the third radiator 37, V2X communication may be smoothly carried out.

Referring to FIG. 3, according to an embodiment, the third radiator 37 may be spaced a predetermined distance apart on one or two sides of the direction in which the first radiator 31 and the second radiator 33 are arranged. Here, two sides of the direction in which the first radiator 31 and the second radiator 33 are arranged may be, for example, a right area and a left area of the direction (ex, Y-axis direction) in which the radiator 31 and the second radiator 33 are arranged when the first radiator 31 and the second radiator 33 are arranged in a line in an arbitrary direction (ex, Y-axis direction), and as shown in FIG. 3, may be realized as an area in which the third radiator 37 is disposed. Additionally, one side of the direction in which the first radiator 31 and the second radiator 33 are arranged may be implemented as a partial area of the two sides, i.e., a right area or a left area.

Figure 6:
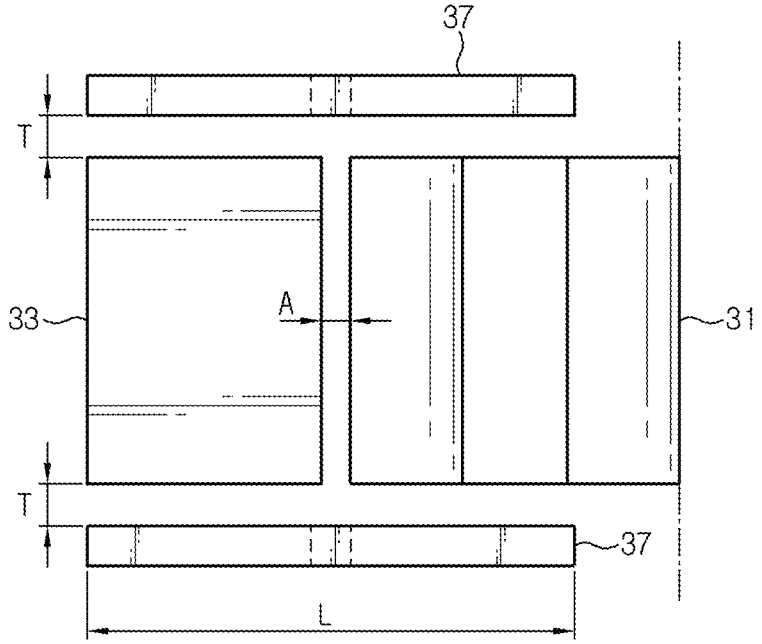
FIG. 6 is a diagram illustration a preferred arrangement between elements of a V2X antenna of FIG. 3.

The third radiator 37 according to an embodiment may extend in the lengthwise direction in parallel with the first radiator 31 and the second radiator 33 on two sides of the direction in which the first radiator 31 and the second radiator 33 are arranged, by support of a support 37*a*. When viewed from the top of FIG. 3 (A direction in FIG. 3), one end of the third radiator 37 does not reach the end of the first radiator 31, and the other end of the third radiator 37 corresponds to the end of the second radiator 33, and thus the full length of the third radiator 37 may be shorter than the length from the end of the first radiator 31 to the end of the second radiator 33, and it detailed description is shown in FIG. 6 to be described below. Additionally, the third radiator 37 may extend in the lengthwise direction in parallel with the first radiator 31 and the second radiator 33 on one side of the direction in which the first radiator 31 and the second radiator 33 are arranged, by support of the support 37*a*.

As shown in FIG. 3, the support 37*a* according to an embodiment may extend in the perpendicular direction from the signal processing substrate 23 and vertically support the central part of the third radiator 37, and may be implemented in the shape of alphabet letter 'T' on the whole together with the third radiator 37. In this instance, when viewed from the side of FIG. 3 (B direction in FIG. 3), an upper surface of the second radiator 33, i.e., an upper surface 331 implemented as '—' shape in the '¬' shape may be hidden by the third radiator 37, and in this instance, the support 37*a* may have a height enough to hide the upper surface 331. Here, the upper surface 331 of the second radiator 33 is described in detail in FIG. 5 below.

Additionally, the support 37*a* may support the central part of the third radiator 37 as shown in FIG. 3, but is not limited thereto, and may support any part of the third radiator 37. Accordingly, the support 37*a* may be vertically coupled to the end of one end or the other end of the third radiator 37, and along with the third radiator 37, may be implemented in the shape of '¬' on the whole.

Referring to FIG. 4, according to another embodiment, the third radiator 37 may be spaced a predetermined distance apart on one or two sides of the direction in which the first radiator 31 and the second radiator 33 are arranged. Here, two sides of the direction in which the first radiator 31 and the second radiator 33 are arranged may be, for example, a right area and a left area of the direction (ex, Y-axis direction) in which the radiator 31 and the second radiator 33 are arranged when the first radiator 31 and the second radiator 33 are arranged in a line in an arbitrary direction (ex, Y-axis direction), and as shown in FIG. 4, may be realized as an area in which the third radiator 37 is disposed. Additionally, one side of the direction in which the first radiator 31 and the second radiator 33 are arranged may be implemented as a partial area of the two sides, i.e., a right area or a left area.

The third radiator 37 according to another embodiment may extend in the vertical direction from the signal processing substrate 23 and may be disposed on two sides of the direction in which the first radiator 31 and the second radiator 33 are arranged, and referring to FIG. 4, preferably, two sides of an area in which the first radiator 31 and the second radiator 33 are close to each other. In this case, when viewed from the side of FIG. 4 (B direction in FIG. 4), the side of the first radiator 31, or the vertical plane of the second radiator 33 may be partially hidden by the third radiator 37. Here, the side of the first radiator 31 is a support 315 which will be described in detail with reference to FIG. 7 below, and the vertical plane of the second radiator 33 is a vertical plane 333 implemented as '|' shape in the '¬' shape, which will be described in detail with reference to FIG. 5 below. Additionally, the third radiator 37 may extend in the vertical direction from the signal processing substrate 23 and may be disposed on only one side of the direction in which the first radiator 31 and the second radiator 33 area arranged, and referring to FIG. 4, preferably, only one of the two sides of an area in which the first radiator 31 and the second radiator 33 are close to each other.

Additionally, the third radiator 37 according to another embodiment extends in the vertical direction from the signal processing substrate 23, such that the upper end is disposed at a lower position than the upper end of the first radiator 31, and the third radiator 37 may have a length such that the height of the third radiator 37 is lower than the height of the first radiator 31.

Figure 5:
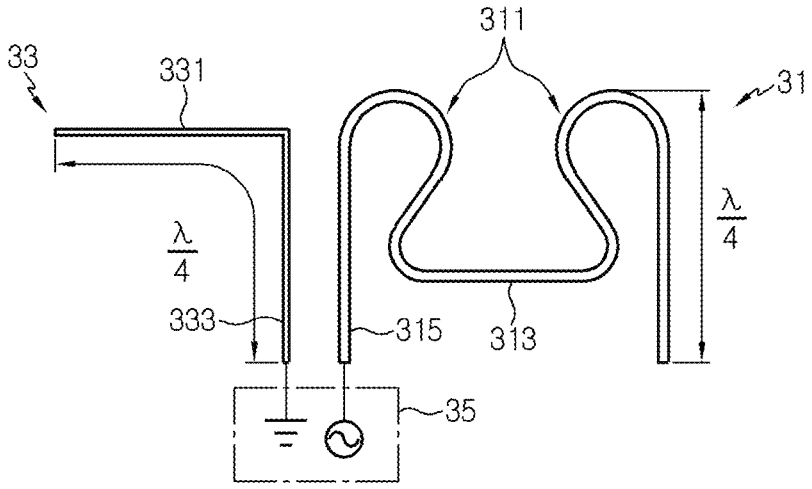
FIG. 5 is a diagram illustrating an electrical configuration of a V2X antenna of FIG. 3.
Figure 5:
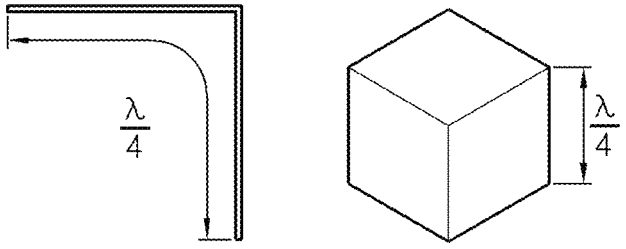

FIG. 5 is a diagram illustrating an electrical configuration of the V2X antenna of FIG. 3. FIG. 5(*a*) is a brief illustration of the physical shape of the first radiator 31 and the second radiator 33, and FIG. 5(*b*) illustrates the length as a function of the electrical shape of the first radiator 31 and the second radiator 33.

Referring to FIG. 5(*a*), the first radiator 31 and the second radiator 33 are made of a conductive material and act as a radiator, and they radiate an RF signal fed and receive an RF signal transmitted from the outside.

The first radiator 31 may be electrically connected to the feeder 35 at one end and electrically open at the other end, and may be bent at the central part and formed in a socket shape in cross section. The socket shape may include an entry 311, a bottom 313 and a support 315. When the coupling portion 255*a* of the antenna 255 for communication enters by pressing down, the entry 311 is elastically deformed outwards, and when the coupling portion 255*a* is seated in the bottom 313, two sides of the entry 311 restore to the original position, bringing it into elastic coupling with the coupling portion 255*a* of the antenna 255 for communication. The bottom 313 is formed in a corresponding shape to the shape of the coupling portion 255*a*, and is an area in which the coupling portion 255*a* is seated. The pair of supports 315 may support the socket shape, and referring to FIGS. 3 to 5, one of the pair of supports 315 may be disposed near the vertical plane 333 of the second radiator 33.

Additionally, the first radiator 31 may include an embodiment in which part of the curve may have a different curvature or part of the curve may be linear, not a typical socket shape as shown in FIG. 5(*a*). This is to make the shape of the first radiator 31 correspond to the shape of the coupling portion 255*a* of the antenna 255 for communication to facilitate the coupling with the antenna 255 for communication.

The second radiator 33 may be electrically connected to the feeder 35 at one end and electrically open the other end and may be formed in a folded shape. According to an embodiment, the folded shape is a shape in which part of a straight line is folded and bent, and referring to FIGS. 3 to 5, may be implemented in the shape of '¬'. The '¬' shape may include the upper surface 331 implemented in '—' shape and the vertical plane 333 implemented in '|' shape. The end of the upper surface 331 may be electrically open, the end of the vertical plane 333 may be electrically connected to the feeder 35, and the vertical plane 333 may be disposed near the support 315 on one side among the pair of supports 315 of the first radiator 31. However, the shape of the second radiator 33 is not limited to '¬' shape, and may include various embodiments in which the second radiator 33 is implemented in an electrically symmetrical shape to the first radiator 31.

Referring to FIG. 5(*a*), the feeder 35 provides a feed signal to the first radiator 31 and ground voltage to the second radiator 33. According to another embodiment, the feeder 35 may provide ground voltage to the first radiator 31 and a feed signal to the second radiator 33.

Referring to FIG. 5(*b*), according to an embodiment, the electrical shape of the first radiator 31 may be formed in the shape of a rough hexahedron. That is, when the V2X antenna 257 has electrical properties corresponding to a half wave dipole antenna, each of the height of the electrical hexahedron of the first radiator 31 and the electrical length from one end of the second radiator 33 to the other end has an electrical length corresponding to ¼ of the radiated RF signal wavelength. Accordingly, the frequency (wavelength)

of the radiated RF signal is determined by the electrical length of the first radiator 31 and the second radiator 33.

FIG. 6 is a diagram illustration a preferred arrangement between elements of the V2X antenna of FIG. 3. Additionally, FIG. 6 may be a diagram of arrangement between elements of the V2X antenna when viewed from the top (A direction) in FIG. 3.

Referring to FIG. 6, the first radiator 31 and the second radiator 33 may be spaced a predetermined distance A apart from each other. Preferably, the second radiator 33 may be spaced a distance corresponding to 1/10 of the radiated RF signal wavelength λ apart from the first radiator 31.

Additionally, the third radiator 37 may be spaced a predetermined distance T apart from the first radiator 31 and the second radiator 33. Preferably, the third radiator 37 is spaced a distance corresponding to ¼ of the radiated RF signal wavelength λ apart from the first radiator 31 and the second radiator 33.

Additionally, the electrical length L of the third radiator 37 may correspond to ¼ of the radiated RF signal wavelength, and preferably, the electrical length L may be implemented as a value obtained by multiplying ¼ of the radiated RF signal wavelength by 0.92.

As shown in FIG. 6, the third radiator 37 having the electrical length L has one end not reaching the end of the first radiator 31 and the other end corresponding to the end of the second radiator 33, and thus the full length of the third radiator 37 may be shorter than the distance from the end of the first radiator 31 to the end of the second radiator 33. Additionally, although not shown, the third radiator 37 having the electrical length L may be disposed at an arbitrary point between the end of the first radiator 31 and the end of the second radiator 33.

Figure 7:
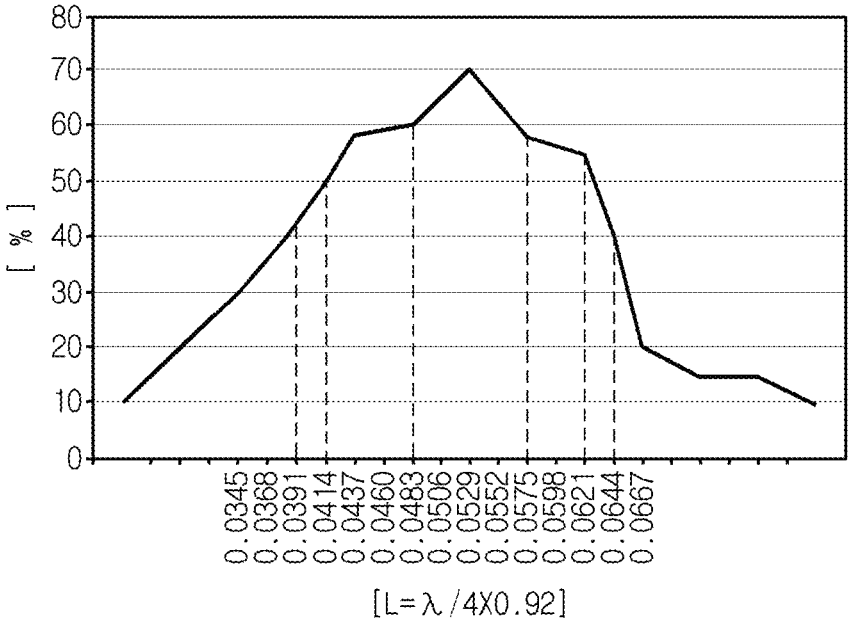
FIG. 7 is a graph showing radiation efficiency as a function of electrical length (L) of a third radiator of FIG. 6.

FIG. 7 is a graph showing radiation efficiency as a function of electrical length L of the third radiator of FIG. 6.

In FIG. 7, the horizontal axis indicates changes in the electrical length ($L=\lambda/4\times0.92$) of the third radiator 37 with changes in the RF signal wavelength λ radiated from the first radiator 31 and the second radiator 33, and the vertical axis indicates the radiation efficiency (%) of the radiator with changes in the electrical length L of the third radiator 37. The values are shown in the following <Table 1>.

TABLE 1

| Wavelength (λ) | Electrical length of T-shaped third radiator (L = λ/4 × 0.92) | Radiation efficiency (%) |
|---|---|---|
| 0.15 | 0.0345 | 30% |
| 0.16 | 0.0368 | 35% |
| 0.17 | 0.0391 | 42% |
| 0.18 | 0.0414 | 50% |
| 0.19 | 0.0437 | 58% |
| 0.20 | 0.0460 | 59% |
| 0.21 | 0.0483 | 60% |
| 0.22 | 0.0506 | 63% |
| 0.23 | 0.0529 | 70% |
| 0.24 | 0.0552 | 65% |
| 0.25 | 0.0575 | 59% |
| 0.26 | 0.0598 | 58% |
| 0.27 | 0.0621 | 55% |
| 0.28 | 0.0644 | 40% |
| 0.29 | 0.0667 | 20% |

Referring to FIG. 7 and Table 1, the lower limit of the RF signal wavelength λ radiated from the first radiator 31 and the second radiator 33 may include 0.17 m or more, or 0.18 m or more, or 0.21 m or more, and the upper limit may include 0.25 m or less, or 0.27 m or less, or 0.28 m or less.

For example, the RF signal wavelength λ radiated from the first radiator 31 and the second radiator 33 may include the range between 0.17 m and 0.28 m, and radiation efficiency (ex, 40% or more) may be favorably maintained at the electrical length ($0.0391\ m \le L \le 0.0644\ m$) of the third radiator 37 according to the RF signal wavelength λ.

Figure 8:
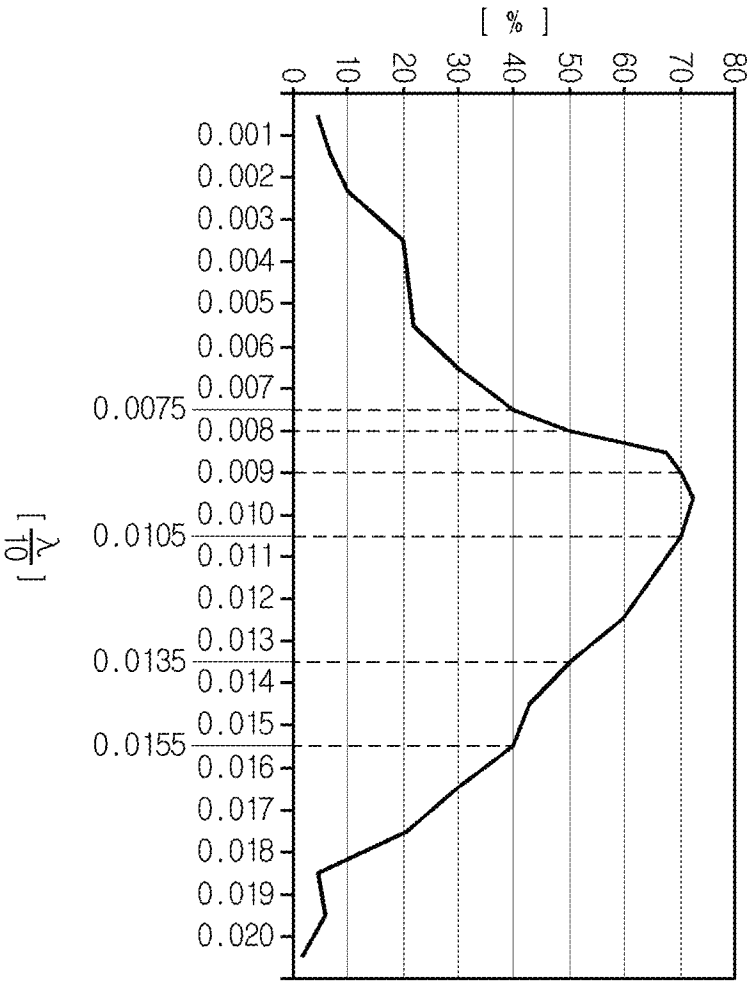
FIG. 8 is a graph showing radiation efficiency as a function of distance (A) between a first radiator and a second radiator of FIG. 6.

FIG. 8 is a graph showing radiation efficiency as a function of distance A between the first radiator and the second radiator of FIG. 6.

In FIG. 8, the horizontal axis indicates changes in the distance ($A=\lambda/10$) between the first radiator 31 and the second radiator 33 with changes in the RF signal wavelength λ radiated from the first radiator 31 and the second radiator 33, and the vertical axis indicates the radiation efficiency (%) of the radiator with changes in the distance A between the first radiator 31 and the second radiator 33. The values are shown in the following <Table 2>.

TABLE 2

| Wavelength (λ) | Distance between first and second radiators (A = λ/10) | Radiation efficiency (%) |
|---|---|---|
| 0.070 | 0.0070 | 35% |
| 0.075 | 0.0075 | 40% |
| 0.080 | 0.0080 | 50% |
| 0.085 | 0.0085 | 68% |
| 0.090 | 0.0090 | 70% |
| 0.095 | 0.0095 | 72% |
| 0.105 | 0.0105 | 70% |
| 0.120 | 0.0120 | 62% |
| 0.125 | 0.0125 | 60% |
| 0.130 | 0.0130 | 58% |
| 0.135 | 0.0135 | 50% |
| 0.140 | 0.0140 | 48% |
| 0.145 | 0.0145 | 42% |
| 0.150 | 0.0150 | 41% |
| 0.155 | 0.0155 | 40% |
| 0.160 | 0.0160 | 35% |

Referring to FIG. 8 and Table 2, the lower limit of the RF signal wavelength λ radiated from the first radiator 31 and the second radiator 33 may include 0.075 m or more, or 0.080 m or more, or 0.090 m or more, and the upper limit may include 0.105 m or less, or 0.0135 m or less, or 0.155 m or less.

Figure 9:
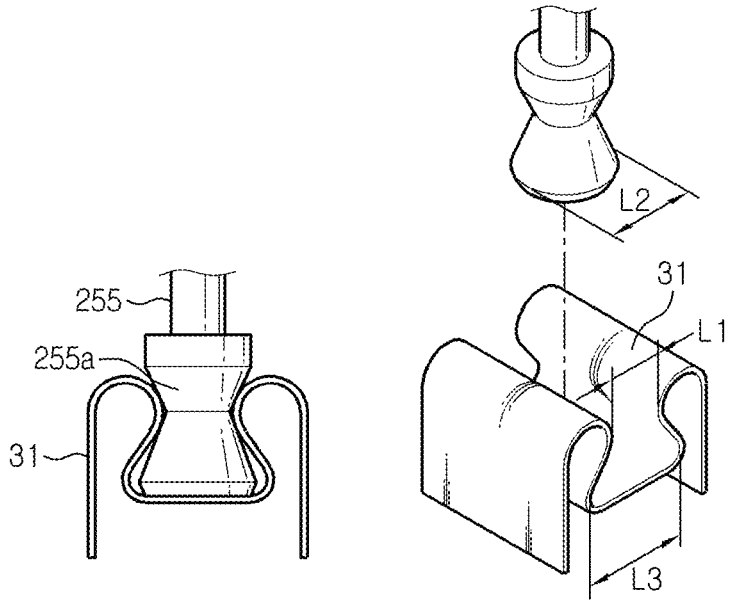
FIG. 9 is a diagram showing an embodiment of a shape of a first radiator of FIG. 3.
Figure 9:
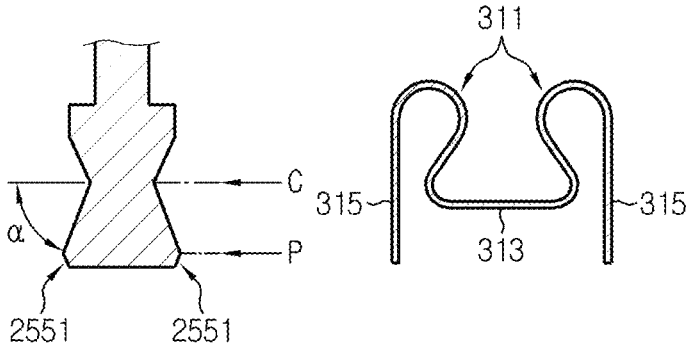

For example, the RF signal wavelength λ radiated from the first radiator 31 and the second radiator 33 may include the range between 0.075 m and 0.155 m, and radiation efficiency (ex, 40% or more) may be favorably maintained at the distance ($0.0075\ m \le A \le 0.0155\ m$) between the first radiator 31 and the second radiator 33 according to the RF signal wavelength λ. FIG. 9 is a diagram showing an embodiment of the shape of the first radiator of FIG. 3, FIG. 10 is a diagram showing another embodiment of the shape of the first radiator of FIG. 3, and FIG. 11 is a diagram showing still another embodiment of the shape of the first radiator of FIG. 3.

Figure 10:
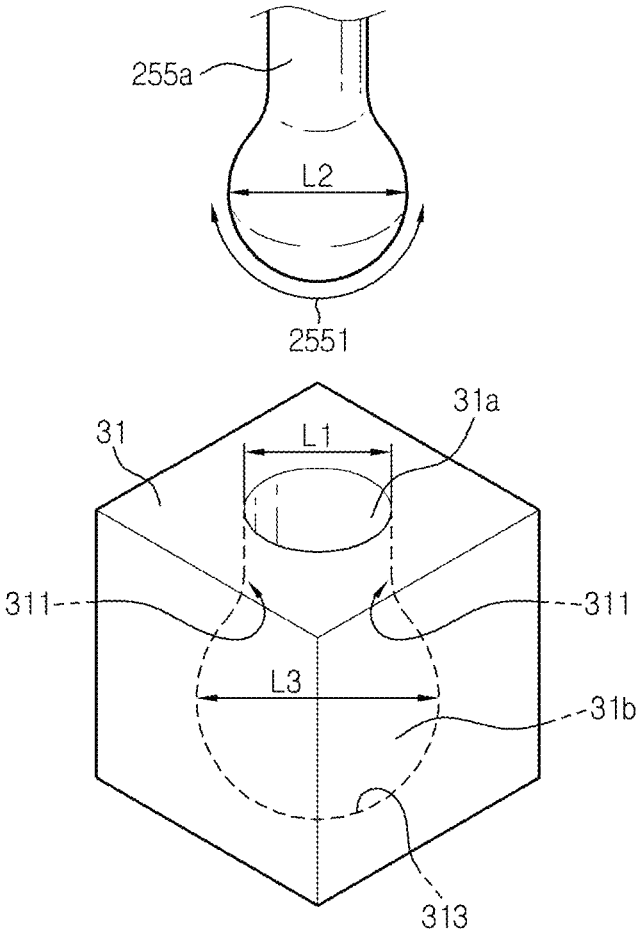
FIG. 10 is a diagram showing another embodiment of a shape of a first radiator of FIG. 3.
Figure 11:
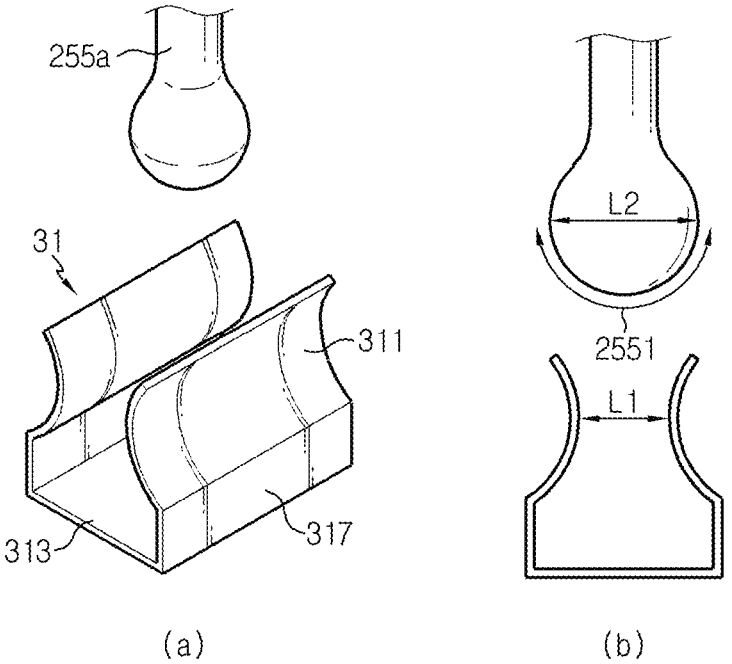
FIG. 11 is a diagram showing still another embodiment of a shape of a first radiator of FIG. 3.

In FIGS. 9 to 11, the first radiator 31 includes various embodiments in which the first radiator 31 is made of an elastic material and forms a ball-socket unit with the coupling portion 255*a*. Although the second radiator 33 is not shown in FIGS. 9 to 11, the second radiator 33 in the shape shown in FIG. 3 may act as a radiator in pair with the first radiator 31 shown in FIGS. 9 to 11.

In FIGS. 9 to 11, the first radiator 31 may be formed with a socket structure of various shapes and elastically coupled with the coupling portion 255*a* of ball shape.

Referring to FIG. 9(*a*), according to an embodiment, the coupling portion 255*a* is not a typical ball shape and may be formed in the shape of a mortar on the whole with some areas being curved inwards to prevent the separation when coupling. In this case, the first radiator 31 may be formed in a socket shape corresponding to the ball shape of the coupling portion 255*a* by changing a curvature of part of the curve or linearizing part of the curve so that the shape of the first radiator 31 corresponds to the shape of the coupling portion 255*a*. This is to make the shape of the first radiator 31 correspond to the shape of the coupling portion 255*a* to facilitate the coupling with the antenna 255 for communication.

Describing in more detail, in FIG. 9(*b*), the coupling portion 255*a* is such that a surface leading from an inward curved portion C to a protruding portion P forms an acute angle ($\alpha°<90°$) with the horizontal plane, and is curved downwards from the protruding portion P again, and in this instance, a surface that is curved downwards from the protruding portion P is a guide 2551 for facilitating the coupling with the first radiator 31.

The first radiator 31 is open upwards and the center of the cross section in the left and right direction is formed in a socket shape, so the entire cross section is similar to the shape of alphabet letter 'M' with the cross section central part formed in a socket shape.

The socket shape may have the entry 311, the bottom 313 and the support 315. As shown in FIG. 9(*b*), a pair of entries 311 has the entry diameter L1 corresponding to the distance between two sides that is smaller than the diameter L2 of the protruding portion P of the coupling portion 255*a*, and when the coupling portion 255*a* of the antenna 255 for communication enters by pressing down, two sides of the pair of entries 311 is elastically deformed outwards, and when the coupling portion 255*a* is seated in the bottom 313, two sides of the entry 311 restore to the original position, bringing it into elastic coupling with the coupling portion 255*a* of the antenna 255 for communication. The bottom 313 is implemented in a shape corresponding to the shape of the coupling portion 255*a* and is an area in which the coupling portion 255*a* is seated, and the internal diameter L3 of the bottom 313 may be equal to the diameter L2 of the coupling portion 255*a* (L2=L3), or slightly larger than the diameter L2 of the coupling portion 255*a* (L2<L3). The support 315 may support the socket shape.

Accordingly, as the first radiator 31 is implemented in the shape shown in FIG. 9, when the coupling portion 255*a* is press-fitted into the first radiator 31, two sides of the entry 311 of the first radiator 31 may be elastically deformed and elastically coupled with the coupling portion 255*a*.

Referring to FIG. 10, according to another embodiment, the coupling portion 255*a* may be formed in a typical ball shape. In this case, the first radiator 31 may be formed in a socket shape corresponding to the ball shape of the coupling portion 255*a*. This to make the shape of the first radiator 31 correspond to the shape of the coupling portion 255*a* to facilitate the coupling with the antenna 255 for communication.

Describing in more detail, in FIG. 10, the coupling portion 255*a* is formed in a typical ball shape, and a lower curved portion from the diameter passing through the center of the sphere is the guide 2551 for facilitating the coupling with the first radiator 31.

The first radiator 31 is formed of a hexahedron on the whole, with an opening 31*a* formed on the upper surface of the hexahedron and an insertion groove 31*b* recessed therein, and the coupling portion 255*a* is inserted and fixed to the insertion groove 31*b*, and the first radiator 31 may be formed in a socket shape corresponding to the ball shape of the coupling portion 255*a* on the whole.

The socket shape may have the entry 311 and the bottom 313. As shown in FIG. 10, the entry 311 is formed with the entry diameter L1 corresponding to the distance between two sides that is smaller by a predetermined distance than the diameter L2 of the protruding portion P of the coupling portion 255*a*, and when the coupling portion 255*a* of the antenna 255 for communication enters by pressing down, two sides of the entry 311 is elastically deformed outwards, and when the coupling portion 255*a* is seated in the bottom 313, two sides of the entry 311 restore to the original position, bringing it into elastic coupling with the coupling portion 255*a* of the antenna 255 for communication. The bottom 313 may be implemented in a spherical shape corresponding to the shape of the coupling portion 255*a* and may be an area in which the coupling portion 255*a* is seated, and the internal diameter L3 passing through the center of the sphere of the bottom 313 may be equal to the diameter L2 passing through the center of the sphere of the coupling portion 255*a* (L2=L3), or slightly larger than the diameter L2 (L2<L3).

As the first radiator 31 is implemented in the shape as shown in FIG. 10, when the coupling portion 255*a* is press-fitted into the first radiator 31, two sides of the entry 311 of the first radiator 31 may be elastically deformed and the bottom 313 corresponding to the ball shape of the coupling portion 255*a* may be coupled with the coupling portion 255*a*.

Referring to FIG. 11, according to still another embodiment, the coupling portion 255*a* may be formed in a typical ball shape. In this case, the first radiator 31 may have a cross section formed in a socket shape such that the shape of the first radiator 31 corresponds to the ball shape of the coupling portion 255*a*. This to make the shape of the first radiator 31 correspond to the shape of the coupling portion 255*a* to facilitate the coupling with the antenna 255 for communication.

Describing in more detail, in FIG. 11, the coupling portion 255*a* is formed in a typical ball shape, and the lower curved portion from the diameter passing through the center of the sphere is the guide 2551 for facilitating the coupling with the first radiator 31.

The first radiator 31 may be formed of a plane extending from one side to the opposing side, and may include an entry 311, an extension 317 and a bottom 315. A pair of entries 311 may be detachably provided with the coupling portion 255*a*, and the extension 317 may extend from the bottom 315, and may be formed in pair in a symmetric shape, spaced a preset distance apart to form an insertion space in which the coupling portion 255*a* is seated. The bottom 315 may support the first radiator 31, and the lower surface of the coupling portion 255*a* may be seated in the bottom 315.

Referring to FIG. 11, the pair of entries 311 may be rounded and extend from the extension 317 with the increasing spacing as it goes from the center to the edge so that the opposing portions may be convexly formed. That is, as it goes far away from the extension 317, the pair of entries 311 may be rounded such that the spacing between the pair of extensions 31*d* reduces and then increases again.

Additionally, the spacing L1 between the centers of the pair of entries 311 is smaller by a predetermined distance than the diameter L2 passing through the center of the sphere of the coupling portion 255*a*, and when the coupling portion 255*a* is press-fitted into the first radiator 31, the pair of entries 311 may be elastically deformed and elastically coupled with the coupling portion 255*a*.

Figure 12:
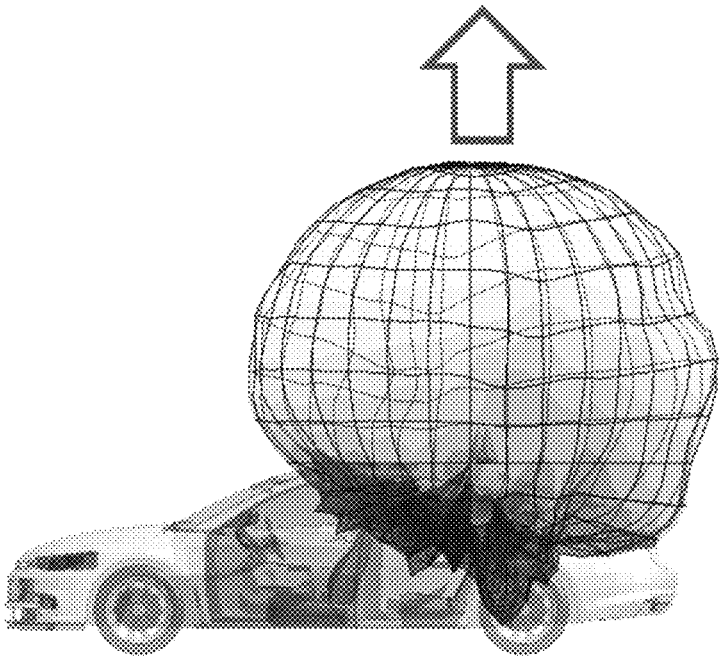
FIG. 12 is a diagram showing a beam pattern radiated from a V2X antenna according to an embodiment.
Figure 12:
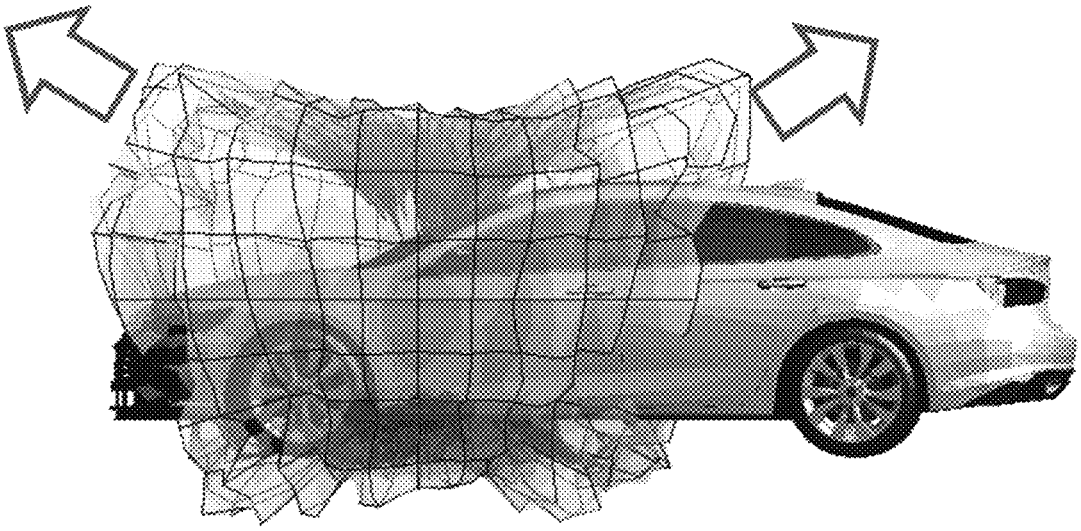

FIG. 12 is a diagram showing a beam pattern radiated from the V2X antenna according to an embodiment. FIG. 12(*a*) is an exemplary diagram showing a conventional 5.8 GHZ antenna beam pattern, and FIG. 12(*b*) is an exemplary diagram showing a 5.8 GHZ antenna beam pattern according to an embodiment of the present disclosure.

Referring to FIG. 12(*a*), when the conventional antenna apparatus for a vehicle is implemented as a Shark Fin Type antenna, in many cases, the shark fin type antenna uses an automobile roof as GND. When the antenna apparatus is placed in the automobile roof, a 5.8 GHZ high frequency beam pattern is reflected on the ground, and a beam peak appears upwards in the arrow direction as indicated in FIG. 12(*a*), so radiation in the direction of the horizontal plane suitable for V2X communication is not smooth.

The present disclosure includes the third radiator 37 on one or two sides of the direction in which the first radiator 31 and the second radiator 33 are arranged, to obtain optimal radiation with respect to the horizontal plane for the purpose of smooth communication between the antenna apparatus 20 for a vehicle mounted in the automobile roof. That is, the third radiator 37 may increase directivity in the frontward/rearward direction of the vehicle by controlling the beam pattern radiated from the first radiator 31 and the second radiator 33, to achieve smooth V2X communication.

Referring to FIG. 12(*b*), according to an embodiment, the V2X antenna 257 may provide an antenna optimized for a horizontal angle by beam tilting through the third radiator 37 in about 5.8 GHZ band (ex, WAVE frequency) for optimal V2X communication. FIG. 12(*b*) shows that an optimal radiation pattern in the horizontal direction is formed by inducing the beam of the antenna frontwards/rearwards by the control of the third radiator 37, realizing a beam pattern suitable for V2X communication.

While the present disclosure contains many features, such features should not be interpreted as limiting the scope of the present disclosure or the appended claims. Certain features described in individual embodiments of the present disclosure may be implemented in combination in a single embodiment. On the contrary, various features described in a single embodiment may be individually implemented in various embodiments or may be implemented in any suitable combination.

Although the drawings describe the operations in a specific order, one should not interpret that the operations are performed in a specific order as shown in the drawings or successively performed in a continuous order, or all the operations are performed to obtain a desired result. Multitasking or parallel processing may be advantageous under a particular environment. Also, it should be understood that all embodiments do not require the distinction of various system components made in the above mentioned embodiment. The program components and systems may be generally implemented as a single software product or multiple software product packages.

The above mentioned method of the present disclosure may be implemented as programs and recorded in computer-readable recording media (such as, for example, a compact disk-read only memory (CD ROM), random access memory (RAM), read-only memory (ROM), floppy disks, hard disks, magneto-optical disks, and the like). This process may be easily performed by person having ordinary skill in the technical field to which the present disclosure belongs, and its detailed description is omitted herein.

It should be noted various substitutions, modifications, and changes may be made to the present disclosure by person having ordinary skill in the technical field to which the present disclosure belongs without departing from the technical aspects of the present disclosure, and the present disclosure is not limited by the above described embodiments and the accompanying drawings.

What is claimed is:

1. An antenna apparatus for a vehicle, comprising:

a first antenna connected to a signal processing substrate; and a second antenna connected to the signal processing substrate through the first antenna and operating in a frequency band different from that of the first antenna, wherein the first antenna comprises:

a first radiator for detachably fixing one end of the second antenna;

a second radiator operated as a dipole antenna together with the first radiator; and a third radiator for controlling a beam pattern radiated by the first radiator and the second radiator.

2. The antenna apparatus for a vehicle according to claim 1, wherein the third radiator includes a support extending in a perpendicular direction of the signal processing substrate, and the third radiator is vertically coupled to the support and disposed on one or two sides of a direction in which the first radiator and the second radiator are arranged.

3. The antenna apparatus for a vehicle according to claim 2, wherein the third radiator includes an electrical length corresponding to a value obtained by multiplying ¼ of a signal wavelength radiated from the first radiator and the second radiator by 0.92.

4. The antenna apparatus for a vehicle according to claim 3, wherein the signal wavelength is in a range between 0.17 m and 0.28 m.

5. The antenna apparatus for a vehicle according to claim 2, wherein the third radiator is spaced apart by a distance corresponding to ¼ of a signal wavelength radiated from the first radiator and the second radiator.

6. The antenna apparatus for a vehicle according to claim 1, wherein the third radiator extends in a perpendicular direction of the signal processing substrate and is disposed on one or two sides of an area in which the first radiator and the second radiator are close to each other.

7. The antenna apparatus for a vehicle according to claim 1, wherein when the second antenna is press-fitted into the first radiator, the first radiator is elastically deformed and elastically coupled with one end of the second antenna.

8. The antenna apparatus for a vehicle according to claim 7, wherein the first radiator is formed in a socket shape corresponding to a ball shape of one end of the second antenna for elastic coupling with the second antenna, and an entry diameter of the socket shape is smaller than a diameter of the ball shape.

9. The antenna apparatus for a vehicle according to claim 8, wherein the first radiator is a metal plate of a conductive material and is formed in the socket shape in cross section with one end electrically connected to a feeder, the other end being electrically open and a central part being bent.

10. The antenna apparatus for a vehicle according to claim 7, wherein the first radiator is a hexahedron of a conductive material with an opening formed on an upper surface and an insertion groove recessed therein, and an entry diameter of the opening is smaller than a diameter of a ball shape of one end of the second antenna and the insertion groove is formed in a socket shape corresponding to the ball shape of one end of the second antenna.

11. The antenna apparatus for a vehicle according to claim 7, wherein the first radiator includes:

a base; and a pair of extensions extending from the base and having opposing convex portions.

12. The antenna apparatus for a vehicle according to claim 11, wherein the pair of extensions are spaced a preset distance apart and elastically deformable.

13. The antenna apparatus for a vehicle according to claim 7, wherein the second radiator is formed in a folded shape with one end being electrically connected to the feeder and the other end being electrically open.

14. The antenna apparatus for a vehicle according to claim 13, wherein the first radiator and the second radiator are spaced apart by a distance corresponding to 1/10 of a signal wavelength radiated from the first radiator and the second radiator.

15. The antenna apparatus for a vehicle according to claim 14, wherein the signal wavelength is in a range between 0.075 m and 0.155 m.

* * * * *